US005089745A

United States Patent [19]

Iannini

[11] Patent Number: 5,089,745

[45] Date of Patent: * Feb. 18, 1992

[54] AMUSEMENT DEVICE INCORPORATING GAS DISCHARGE TUBE

[75] Inventor: Robert E. Iannini, Mont Vernon, N.H.

[73] Assignee: Bertonee Inc., Canada

[ * ] Notice: The portion of the term of this patent subsequent to May 3, 2005 has been disclaimed.

[21] Appl. No.: 559,403

[22] Filed: Jul. 23, 1990

Related U.S. Application Data

[63] Continuation of Ser. No. 278,254, Nov. 30, 1988, abandoned.

[51] Int. Cl.[5] ..... H01K 7/00; H05B 37/00; H05B 41/16; G08B 3/00

[52] U.S. Cl. ..... 315/76; 315/227 R; 315/236; 315/248; 116/202; 340/691; 446/485; 324/158 R

[58] Field of Search ..... 315/248, 227 R, 236, 315/76; 128/734; 446/484, 485; 272/8 R, 8 N; 324/158 R; 116/202; 340/612, 660, 691

[56] References Cited

U.S. PATENT DOCUMENTS

| | | | |
|---|---|---|---|
| 1,654,068 | 12/1927 | Blattner | 315/76 |
| 1,785,070 | 12/1930 | Case | 315/76 |
| 1,790,903 | 2/1931 | Craig | 315/76 |
| 2,437,009 | 3/1948 | Warner | 40/545 |
| 4,282,681 | 8/1981 | McCaslin | 446/484 |
| 4,431,947 | 2/1984 | Ferriss et al. | 315/248 |
| 4,494,554 | 1/1985 | Van Dyke et al. | 128/734 |
| 4,537,203 | 8/1985 | Machida | 128/734 |
| 4,678,450 | 7/1987 | Scolari et al. | 315/241 P |
| 4,742,278 | 5/1988 | Iannini | 315/227 R |

FOREIGN PATENT DOCUMENTS 423262 1/1935 United Kingdom .

OTHER PUBLICATIONS

Ajemian "The New Level Meters" Dec. 1980, *AUDIO*, pp. 34–37.

*Primary Examiner*—Eugene R. LaRoche
*Assistant Examiner*—Michael B. Shingleton
*Attorney, Agent, or Firm*—Davis, Bujold & Streck

[57] ABSTRACT

An amusement device comprising a gas-filled plasma discharge tube; an electrode adjacent an end of the tube for coupling high-frequency, high-voltage energy into the gas in the plasma discharge tube; an ionization energy supply operably connectable to a source of electrcity for producing an adjustable high-frequency, high-voltage energy at an output thereof having an upper limit sufficient to ionize the gas in the plasma discharge tube without a ground return by utilizing the electrical capacity of the surroundings to provide a reactive impedance for plasma tube current to flow into, the electrode being operable connected to the output; and, a control circuit operably connected to the ionization energy supply for adjusting the level of the high-frequency, high-voltage energy at the output between levels causing ionization of the gas in the plasma discharge tube to occur in differing amounts as a function of a changing stimulus connected to an input thereof. There are embodiments as a light saber, an emotions meter, or the like, and a "Dancing Plasma Fire" device driven by an audio source. The preferred electrode capacitively couples to the discharge tube.

10 Claims, 3 Drawing Sheets

AMUSEMENT DEVICE INCORPORATING GAS DISCHARGE TUBE

This is a continuation of copending application Ser. No. 07/278,254, filed on Nov. 30, 1988.

BACKGROUND OF THE INVENTION

The present invention relates to amusement devices incorporating a lightemitting display tube and, more particularly, to an amusement device comprising, a gas-filled plasma discharge tube; electrode means adjacent an end of the tube for coupling high-frequency, high-voltage energy into the gas in the plasma discharge tube; ionization energy supply means operably connectable to a source of electricity for producing an adjustable high-frequency, high-voltage energy at an output thereof having an upper limit sufficient to ionize the gas in the plasma discharge tube without a ground return by utilizing the electrical capacity of the surroundings to provide a reactive impedance for plasma tube current to flow into, the electrode means being operably connected to the output; and, control circuit means operably connected to the ionization energy supply means for adjusting the level of the high-frequency, high-voltage energy at the output between levels causing ionization of the gas in the plasma discharge tube to occur in differing amounts as a function of a changing stimulus connected to an input thereof.

Gas discharge displays have been used for a long time. The most familiar is the so-called "neon sign" that is used to advertise everything from apples to zebras. As depicted in FIG. 1, there is a glass tube 10 which is typically bent to form letters, figures, etc. The tube 10 is filled with an inert gas such as neon and has a pair of electrodes 12 sealed through the respective ends of the tube 10. The electrodes 12 are connected to a power supply 14 which creates an electrical potential between the electrodes 12 through the gas in the tube 10. This electrical potential causes the gas to ionize and glow with a color characteristic of the gas. For example, ionized neon emits light in the orange color range. By coloring the glass of the tube 10, signs of various colors can be created.

In my U.S. Pat. No. 4,742,278, I described a method and apparatus for selectively illuminating a gas discharge tube with only one electrode as depicted in FIG. 2. There is still a sealed glass tube 10 with an inert gas inside. There is a single electrode 12 connected to a power supply 14'. The electrical potential from the electrode 12 through the gas within the tube 10 is by capacitance to the surrounding air with the glass of the tube acting as an insulator. By varying the characteristics of the power applied by the power source 14' the gas within the tube can be made to vary with distance from the electrode 12 to create different effects. For example, the tube 10 can be made to progressively illuminate in a strobing effect from ionization only adjacent the electrode 12 to full ionization of the gas within the tube 10.

Amusement devices incorporating light tubes and/or displays are very popular. For example, following the well known Star Wars movie series, many examples of the so-called "light sabers" used by the characters in the movie were sold in toy stores. Typically in such toys, a translucent plastic tube is fastened to the front of a flashlight which acts as the handle. When the flashlight bulb is illuminated, the plastic tube lights up or glows from the light inside. The effect is simple and certainly not very dramatic.

So-called "light organs" are also popular amusement devices. Simple units employ a plurality of small incandescent bulbs. More elaborate (and much more expensive) units employ plasma spheres. In each case, light being emitted by the device is modulated as a function of sound energy. Thus, the light organ reflects the various factors of the sound in the room. For example, as there is a drum beat in music being used to modulate the device, the light will pulsate in time with the drum beat.

Various forms of meters measuring one thing and another are also popular amusement devices. The more colorful and interesting the display associated with the device, the more likely it is to be popular. A "kiss meter" that measures the desirability of a person's kiss on a three inch meter with a number scale of 1 to 10 in black letters on a white face is not going to have as much appeal as one that lights up and rings bells for a good kisser.

Wherefore, it is the object of the present invention to provide a family of amusement devices which have great user appeal through the incorporation of my controlled gas discharge display tube therein.

Other objects and benefits of this invention will become apparent from the description which follows hereinafter when taken in conjunction with the drawing figures which accompany it.

SUMMARY

The foregoing object has been achieved by the amusement device of the present invention comprising, a gas-filled plasma discharge tube; electrode means adjacent an end of the tube for coupling high-frequency, high-voltage energy into the gas in the plasma discharge tube; ionization energy supply means operably connectable to a source of electricity for producing an adjustable high-frequency, high-voltage energy at an output thereof having an upper limit sufficient to ionize the gas in the plasma discharge tube without a ground return by utilizing the electrical capacity of the surroundings to provide a reactive impedance for plasma tube current to flow into, the electrode means being operably connected to the output; and, control circuit means operably connected to the ionization energy supply means for adjusting the level of the high-frequency, high-voltage energy at the output between levels causing ionization of the gas in the plasma discharge tube to occur in differing amounts as a function of a changing stimulus connected to an input thereof.

In one embodiment the device is a light saber and additionally comprises a handle portion for gripping having the plasma discharge tube extending outward therefrom and a pair of electrically conductive electrodes disposed on the handle portion in non-contacting relationship, the electrodes being connected to the input of the control circuit means whereby changes in resistance between the electrodes when bridged by a hand during gripping of the handle portion will provide the changing stimulus to the control circuit means. In this embodiment, the source of electricity is a battery and the battery, the ionization energy supply means, and the control circuit means are disposed within the handle portion.

In another embodiment, the device is a meter device and additionally comprises a meter case having the plasma discharge tube extending along a surface thereof as an indicator where the surface has conditional indicia thereon disposed adjacent and parallel to the plasma discharge tube whereby progressive illumination of the plasma discharge tube causes the plasma discharge tube in combination with the indicia to indicate degrees of a condition; and, input means having a pair of electrically conductive electrodes disposed thereon for contact with a variably resistive element, the electrodes being in non-contacting relationship and being connected to the input of the control circuit means whereby changes in resistance between the electrodes when bridged by a variably resistive element will provide the changing stimulus to the control circuit means. Preferably, for use as a emotion meter, pseudo lie detector, or the like, the a pair of electrically conductive electrodes are disposed for contact with a portion of a human body and the conditional indicia are chosen to reflect the characteristic of a human.

In yet another embodiment the device is a light organ type device and additionally comprises a base having the plasma discharge tube extending outward therefrom and audio input means connected to the input of the control circuit means for applying an audio signal thereto whereby changes in the audio signal provide the changing stimulus to the control circuit means. In one version of this embodiment the audio input means comprises microphone means for developing an electrical signal at an output thereof reflecting sounds heard by the microphone means and amplifier means operably connected to the input of the control circuit means for receiving the electrical signal at an input thereof and for amplifying the electrical signal to a level sufficient to stimulate the control circuit means into ionizing the gas in the plasma discharge tube as a function of the audio signal. In another version, the audio input means comprises means for receiving an amplified audio signal from an outside source and for applying the electrical signal to the input of the control circuit means to stimulate the control circuit means into ionizing the gas in the plasma discharge tube as a function of the audio signal.

DESCRIPTION OF THE DRAWINGS

FIG. 6 is a simplified drawing showing the inventor' approach to providing a single electrode for a gas discharge tube with the electrode mounted within the tube.

FIG. 7 is a simplified drawing showing the inventor' approach to providing a single electrode for a gas discharge tube with the electrode comprising multiple turns of wire, or metal tape, a metal cylinder, etc., on the exterior of the tube affecting a capacitive electrical connection to the gas within the tube.

FIG. 8 is a wiring diagram for a circuit to be employed with the light saber amusement device of FIG. 3 or the love meter amusement device of FIG. 4, or the like.

DESCRIPTION OF VARIOUS EMBODIMENTS

Figure 1:
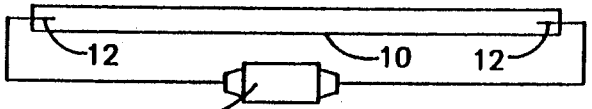
PRIOR ART FIG. 1
FIG. 1 is a simplified drawing of a prior art gas discharge display tube of the type wherein a tube filled with an inert gas such as neon has electrodes at the respective ends which are connected to a power supply.
Figure 2:
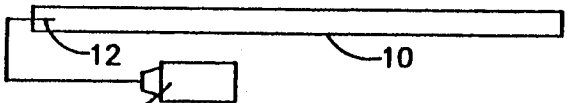
PRIOR ART FIG. 2
FIG. 2 is a simplified drawing of a gas discharge display tube of the type invented by the inventor herein wherein a tube filled with an inert gas such as neon has a single electrode at one end and which operates by virtue of the capacitive connection to the surrounding air through the dielectric of the air.
Figure 3:
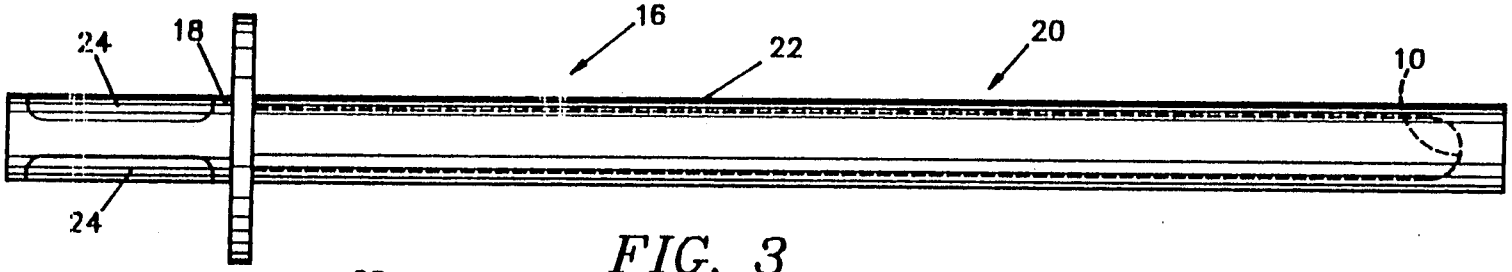
FIG. 3 is a simplified drawing of a "light saber" amusement device according to the present invention.
Figure 4:
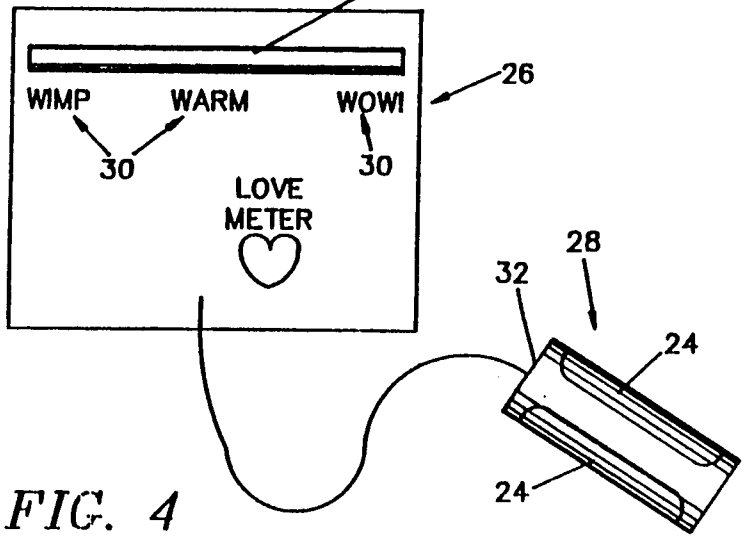
FIG. 4 is a simplified drawing of a "love meter" amusement device according to the present invention.
Figure 5:
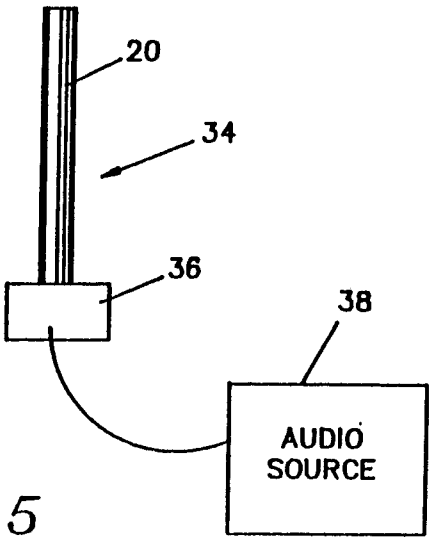
FIG. 5 is a simplified drawing of a "dancing plasma fire" amusement device according to the present invention.

The family of amusement devices of the present invention are characterized by having a gas discharge display which is illuminated under the control of an input device which allows the display to be illuminated in an amusing manner. Several examples of amusement devices according to this invention are depicted in FIGS. 3-5. The light saber 16 of FIG. 3 represents a type of device that can be held and manipulated as part of the amusement process. There is a handle 18 which holds the battery power and control circuitry connected to drive the display tube 20 which extends therefrom. The control circuitry for such a device will be described in detail shortly. For safety purposes, it is preferred that the display tube 20 comprise an outer plastic tube 22 having a closed outer end and containing a glass gas discharge tube 10 substantially like that described above with respect to FIG. 2. The handle 18 has a pair of conductive foil electrodes 24 on the surface thereof which are used to control the ionization of the display tube 20 as a function of the resistance of user's grip on the electrodes 24. Dryness of the gripping hand and the position of the hand on the handle 18 (and electrodes 24), therefore, can be used to vary the display produced by the display tube 20.

FIG. 4 depicts a meter type amusement device 26. The device 26 is labelled as a "love meter" and purportedly indicates the user's love potential as a function of gripping the input device 28. A smaller display tube 20 is mounted on the front of the device 26 adjacent appropriate indicia 30. As should be recognized and appreciated, the single electrode in the display tube 20 is at the left end as the figure is viewed. Thus, the display tube 20 will illuminate from the left side towards the right side. As may have been appreciated from the drawing, the input device 28 is operably connected to the control circuitry within the device 26 and comprises the same functional control elements as in the light saber 16 of FIG. 3. There is a cylindrical plastic grip 32 having the conductive foil electrodes 24 on the surface thereof as in the handle 18 of FIG. 3. Thus, as the input device 28 is gripped, the "lovability" of the user will be displayed as a function of the position of the hand on the electrodes 24 and the moistness of the hands. The control circuitry for the device 26 is, of course, substantially identical to that of the light saber 16 of FIG. 3. As those skilled in the art will readily appreciate, the device 26 can take various forms by simply changing the indicia 30 associated with the display tube 20. Thus, the device 26 could be changed to things as an "emotions meter", "lie detector", or the like. If desired, the device 26 could be packed with the indica 30 on replaceable cards so that one device 26 could be used for various amusement functions according to the desires of the moment. Those skilled in the art will also appreciate that the input device 28 could also take various forms within the scope and spirit of the present invention. All that is required is a changing resistance, or the like, as a function of bodily functions of a user. Thus, the foil electrodes could be placed in a head band to measure changes in resistance on the forehead, etc.

FIG. 5 depicts a light organ type of device sold by the applicant herein as "dancing plasma fire". The drive circuitry therefor will also be described in detail shortly. As depicted in the figure, the dancing plasma fire unit 34 comprises a base 36 containing the power supply and control circuitry. A display tube 20 like that employed in the light saber 16 extends upward from the base 36. Typically, the display tube 20 incorporates a standard piece of straight neon plasma tube of any convenient length between two and five feet. An audio source 38 is connected to drive the circuitry within the base 36 and thereby cause the display tube 20 to ionize as a function of the audio source 38. The audio source 38 can be connected directly to the circuitry within the base 36 or a microphone can be provided in the base 36 and connected to the control circuitry for wirelessly driving the unit 34. Regardless of the connection type (direct connection or wireless with microphone), the sounds from the audio source 38 control the length or height of the plasma ignition within the display tube 20 thus producing the dancing visual display for which the device was named. The effect is coincident with the acoustical intensity of the sound or music and responds accordingly.

Figures 6, 7, 8:
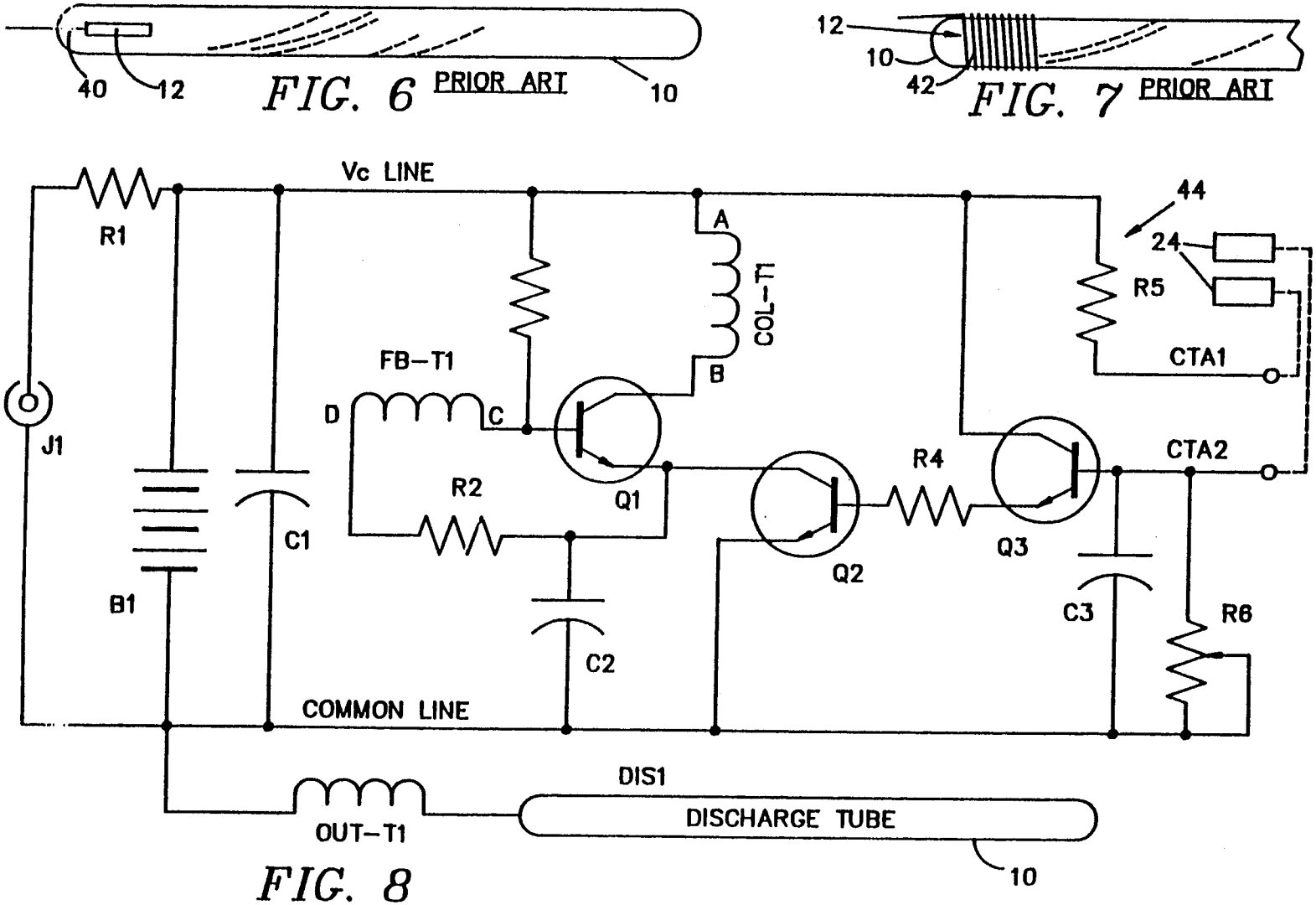
FIG. 7 PRIOR ART
FIG. 6 PRIOR ART

Before addressing the control circuits with particularity, it should be noted that the electrode 12 of the glass plasma tube 10 employed within the display tube 20 of the present invention can be of two types as depicted in FIGS. 6 and 7. As shown in FIG. 6, the electrode 12 can comprise a metal electrode contained within the glass tube 10 and connected by a wire 40 passing through and sealed to the glass of the tube 10 in a manner well known to those skilled in the art of making neon signs and the like. Alternatively, as depicted in FIG. 7, the tube 10 can be completely sealed and the electrode 12 can be affected as a number of turns of wire 42 wrapped around the end of the tube 10 so that the electrical connection to the gas within the tube is accomplished capacitively. Where this approach is used, it is preferred that the wire turns 42 be attached to the glass of the tube 10 by adhesive, tape, or the like. Alternatively, an adhesive, conductive tape, metal cylinder, or the like, could be used for the capacitive electrode 12 in place of the turns of wire 42.

Turning now with particularity to FIG. 8, the preferred circuitry for controlling the ionization of the display tube 20 in devices such as those of FIGS. 3 and 4 will now be described in detail. As mentioned above, by employing my prior patented display tube, the system utilizes a high-frequency, high-voltage plasma power source that requires only one external capacitive electrode or input to the plasma display discharge tube, such as that shown in FIG. 7. This property greatly reduces the cost in producing the plasma tube as no internal electrode or glass-to-metal seals are required. This is an important aspect of amusement type devices which, typically, must be of a low cost to produce in order to sell at prices that consumers will pay. Also eliminated are any grounds or electrical returns as required in conventional systems. Thus, ignition of the plasma discharge appears to occur extending outwardly into space without a return connection. In actuality, high-frequency electrical currents are flowing through the capacitive reactance of the plasma tube with the air, where the glass enclosure (i.e. tube 10) acts as the dielectric between the two.

The control circuit 44 (see Table I for parts list) consists of transistor Q1 connected as a Hartly-type oscillator where its collector is in series with the primary of transformer T1 and is energized by rechargeable battery B1. The drive signal to its base is obtained by a tertiary "feedback" winding FB properly phased to allow oscillation to take place. Base current is limited by resistor R2 and biased into conduction by resistor R3. The oscillations produced are at a frequency of approximately 20 KHz. This is usually determined by the resonant frequency of transformer T1. The gain of transistor Q1, hence the system output, is controlled via the conductance of pass transistor Q2 by biasing its base with an increasing voltage or ramp signal from transistor Q3. Capacitor C2 bypasses any high-frequency signal currents to the common line of the circuit. This approach provides a positively defined state between the energized and deenergized plasma, and hence its lit display length.

The current through transistor Q2 (and thus the emitter bias of transistor Q1) is controlled by the ramp amplifier transistor Q3. Transistor Q3 is now controlled when base current flows from resistor R5. This occurs when the users fingers bridge the two external electrodes 24 and biases transistor Q3 to a point dependent on the user's contact resistance. This effect produces the variable current ramp that controls the output of the system. No off/on switch is necessary since total power is controlled by the user's finger contact on the electrodes 24. Note that a dry hand may require a tighter grip where a damp hand requires only light touch to achieve full plasma ignition. Capacitor C3 bypasses any external signals that may cause premature operation while resistor R6 controls the sensitivity range of the necessary contact resistance for full ignition as well as linearity. Battery B1 is externally charged via jack J1 through current-limiting resistor R1.

As actually constructed for commercial sale by the applicant herein, the device is built in two parts consisting of "display" and "power" sections. These are easily separated for convenience should the plasma display discharge tube 10 become broken or damaged. Also, using this approach, there is the option of using display tubes with other gases producing different colorful effect, etc. In the commercial embodiment, the display section of the device consists of a twenty-six inch length of small diameter neon or other gas tube. Each end of this internal gas tube is simply "pinched off" with one end being wrapped with conductive tape or wire for about one inch in the manner of FIG. 7 for the capacitive input contact. The internal gas tube 10 is centered into a colored plastic tube 22 that (as mentioned above) serves for protection from breakage and provides a more enhanced visual effect due to its diffusive, refractive and defractive optical properties.

TABLE I

| ELECTRONICS PARTS | |
|---|---|
| R1 | 100 ohm ¼ watt resistor |
| R2 | 110 ohm 1 watt resistor (may be ½ watt) |
| R3,5 | 1K ¼ watt resistor |
| R4 | 220 ohm ¼ watt resistor |
| R6 | 100K Trimpot or calibration resistor (not required for normal use) |
| C1 | 100 μfd 25 V electrolytic cap |
| C2 | 2.2 μfd 25 V N.P. electrolytic cap |
| C3 | .1 μfd 25 V disc cap |
| Q1 | 2TIP3055 power tab version NPN |
| Q2 | D40D5 power tab version NPN |
| Q3 | PN2222 NPN G.P. |

TABLE I-continued

| ELECTRONICS PARTS | |
|---|---|
| J1 | 3.5 mm phono jack for charging |
| T1 | Special ferrite transformer (*) |
| DIS1 | Discharge tube (*) |
| B1 | Heavy duty 10.8 volt battery or 9.8 volt Nicad — other batteries with less voltage may reduce system output but should provide full ignition. |

(*) available from Information Unlimited, Box 716, Amherst, NH 03031

Bench testing of the device and circuit 44 can be accomplished by the following procedure:

A. Verify open circuit (infinity reading) across connections to battery B1 (battery B1 removed) with meter lead properly polarized; i.e., plus to Vc and minus to common.

B. Connect discharge tube DIS1 to output of transformer T1. Disconnect resistor R6 or adjust to maximum resistance of Trimpot.

C. Connect fully charged Nicad battery B1. Note zero current flow with meter on the lowest current ranges. Note also that Nicad batteries come in several voltages.

D. Obtain three clip leads and use one to short-out wires to CTA1, CTA2. Use the other two to connect from transformer T1 feedback FB to points C and D, respectively. Note discharge tube DIS1 fully igniting and meter current indicating 400–600 milliamps. If tube DIS1 fails to ignite, reverse clip leads to points C and D and repeat. Solder in place when correct connections are verified. For those who have access to a variable voltage power supply, the following readings with the display tube connected and the contacts shorted should be observed:

| | |
|---|---|
| 5 volts 350 MA | display ⅜ lit |
| 6 volts 450 MA | display ¾ lit |
| 7 volts 525 MA | display fully lit |
| 8 volts 600 MA | display fully lit |
| 9 volts 650 MA | display fully lit |

E. Remove clip lead across CTA1, CTA2 and note battery current falling to zero and tube extinguishing.

F. Bridge the leads to CTA1, CTA2 with fingers and note tube partially igniting. Dampen fingers and note full ignition. Note that resistor R6 is selected to provide a range of positive control for the plasma length with simple touching of the control leads to CTA1, CTA2 (and therefore the contacts 24 in use).

Figure 9:
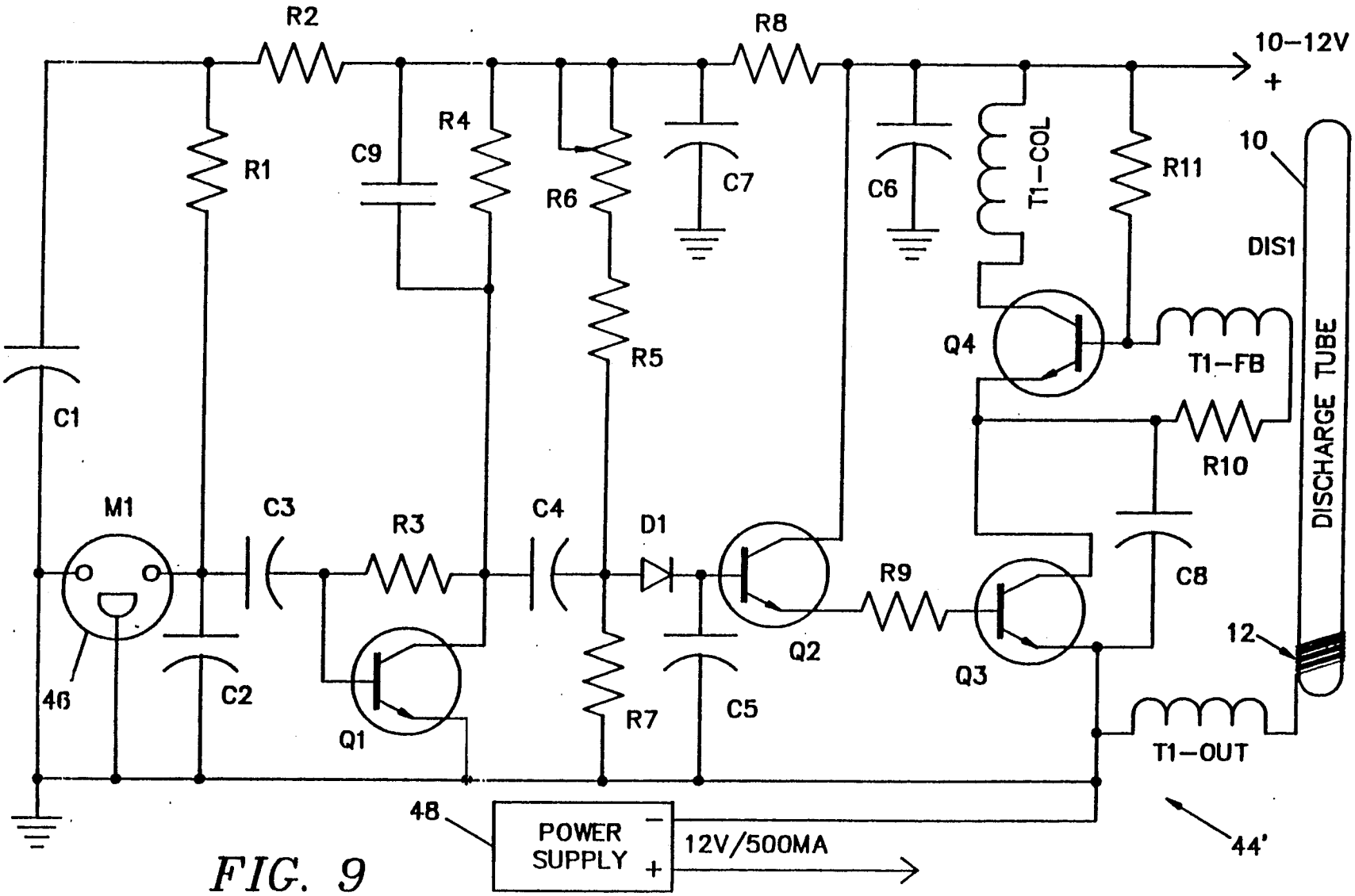
FIG. 9 is a wiring diagram for a circuit to be employed with the dancing plasma fire amusement device of FIG. 5.

Turning now with particularity to FIG. 9, the preferred control circuitry 44' for controlling the ionization of the display tube 20 (i.e. tube 10) in devices such as that of FIG. 5 will now be described in detail. The effect is achieved by utilizing a simple standard piece of straight neon plasma tube of any convenient length as, for example, between two and five feet. Again, a discharge electrode 12 is required only at one end of the tube 10, obviously simplifying its construction and greatly reducing its cost. The display tube 20 (i.e. a glass tube 10 within a plastic tube 22) is mounted in a vertical position with its electrode end being secured in the center of the base 36 that also houses the associated electronic control circuitry 44' (see parts list, Table II). As in the previous case, this circuitry produces the necessary high-frequency, high-voltage energy for igniting the plasma tube 10 without the normal ground return required in conventional systems. This energy utilizes the electrical capacity of the surroundings that provides the necessary reactive impedance for the neon plasma tube current to flow into. The unique property of the system lies in the ability of the energized or ignited plasma to travel up and down the tube 10 producing a very positive light and dark boundary where ignition and non-ignition occurs. The effect is accomplished by controlling the value of voltage feeding the base (i.e. electrode 12) of the plasma tube 10 and is, in turn, (in the preferred commercial embodiment) controlled by several stages of amplification following a microphone 46.

TABLE II

| ELECTRONIC PARTS | |
|---|---|
| R1,5 | 10K ¼ watt resistor |
| R2,11 | 1K ¼ watt resistor |
| R3 | 560K ¼ watt resistor |
| R4 | 6.8K ¼ watt resistor |
| R6 | 500K to 1 Meg Trimpot |
| R7 | 15K ¼ watt resistor |
| R8 | 470K ¼ watt resistor |
| R9 | 220K ¼ watt resistor |
| R10 | 220 ohm 1 watt resistor |
| C1,6 | 100 μfd 250 electrolytic cap |
| C2 | .05 μfd disc or equivalent cap |
| C9 | .1 μfd disc 25-50 V cap |
| C3,4,8 | 2.2 μfd N.P. cap |
| C5 | .47 μfd 25 V electrolytic cap |
| C7 | 1000 μfd 25-50 V cap |
| D1 | IN914 diode |
| Q1,2 | PN2222 NPN G.P. transistors |
| Q3 | D40D5 power tab NPN |
| Q4 | MJ3055 or power tap NPN |
| T1 | Special ferrite transformer (*) |
| M1 | FET microphone (*) |

(*) available from Information Unlimited, Box 716, Amherst, NH 03031

As in circuit 44 described above, transistor Q4 comprises a Hartly oscillator where frequency is determined by the collector winding of transformer T1 and its associated capacity. A feedback winding FB on transformer T1 supplies the properly phased energy through current limiting resistor R10. Resistor R11 turns on transistor Q4 initiating oscillation. The output winding of transformer T1 is fed into single end electrode 12 of the neon plasma discharge tube 10 which, for this application, is usually mounted in a vertical configuration as shown in the drawing. High-frequency energy at a varying voltage now causes the ignited plasma to rise and fall in coincidence with sound or music intensity. A "Dancing Plasma Fire" effect is thus produced.

The desired effect is only made possible by the capacitive reactive impedance produced between the ignited plasma and its surroundings. This value of reactance decreases and hence draws more energy the longer the ignited plasma length becomes. This effect, in turn, is controlled by the value of voltage feeding the plasma tube 10, producing more plasma. The output of the oscillator transistor Q4 is made to vary by changing its operating point. This is accomplished by pass transistor Q3 connected in series with its emitter. Transistor Q2 is connected as a Darlington pair along with transistor Q3 and provides the high impedance input necessary for the remaining drive circuit. This input responds to a ramp of voltage resulting from the amplified audio signal being rectified by diode D1 and integrated on to capacitor C5. The audio sound picked up by microphone M1 is amplified by transistor Q1 whose gain is determined by feedback resistor R3. The output of transistor Q1 is AC coupled to the ramp generator integrating network consisting of diode D1 and capacitors C5 and C4. A DC threshold is set via the mini potentiometer R6 by forward biasing diode D1 just into conduction. This control can also vary the sound to output sensitivity; but, will show a positive threshold effect if D1 is sufficiently biased below conduction. As those skilled in the art will appreciate, the microphone M1 and amplifying transistor Q1 could be replaced with a direct connection to an amplified audio signal such as that output by an audio system to its speakers, or the like.

In the commercial embodiment, power to the system is via a wall-type transformer/power supply 48. This approach is chosen to help obtain easy UL approval, along with an obvious safety advantage. A product of this type can be used in many different applications and environments by users who have no electrical experience at all. For this reason all possible shock hazards have been minimized.

The threshold of the display in this embodiment is controlled by the setting of the potentiometer R6. This setting determines the quiescent point of the ignition. It can be set for "no display", where a certain sound level is required to start ignition. The recommended setting is where display is preset to approximately three to six inches of ignition in a quiet environment. As a result, minimal sounds will cause a change in the display.

The response time of the display can be changed by selection of capacitor C5. Slower response can be obtained by increasing this component to a 1 μfd capacitor or even higher. This may run a bit sluggish; but, may be preferred for certain applications. Conversely, response time can be speeded up by reducing capacitor C5 to 0.2 μfd or lower. This may increase the plasma travel beyond the ability of the eye to detect motion or where the display may appear to "strobe" rather than travel.

The frequency response of the device with the value of components shown is on the low side. This the inventor felt was an advantage in a microphone-driven device as sold by him commercially for elimination of the higher frequencies often encountered with air conditioners and other normal ambient noises. Voices and music more on the base side provide good response. Also, the effect of the operating frequency of the high-voltage transformer is suppressed both electrically and mechanically. High-frequency response is controlled mainly by capacitors C2 and C9.

Sensitivity can be changed by selection of resistor R3—increasing the value for more gain; and, conversely reducing for less. The value shown should be ample for most applications. The plasma discharge tube 10 may be increased in length to the point where potentiometer R6, when fully clockwise, allows full ignition. This is the maximum output of the system. Selection then becomes a choice of mechanical limits.

Wherefore, having thus described my invention, what is claimed is:

I claim:

1. An amusement device comprising an elongated cold cathode gas discharge tube containing an ionizable gas and having a power source to ionize the gas to cause illumination thereof wherein, the gas discharge tube has only one cathode element disposed at one end in contact with the gas, the power source is connected to the one cathode element and produces an alternating voltage referenced to ground potential and of sufficient frequency to cause the gas to ionize through the natural surrounding capacitance between the ionized gas and ground potential, and the power source produces a variable voltage output whereby the length of ionization of the gas along the discharge tube in a direction away from the one cathode element is varied depending upon voltage output, and control circuit means operably connected to the power source for adjusting the voltage level of the variable voltage output therefrom between levels causing ionization of the gas in the tube to occur in differing amounts as a function of a changing stimulus connected to an input of said control circuit means.

2. The amusement device of claim 1 wherein the device is a light saber and additionally comprising:

a) a handle portion for gripping having the plasma discharge tube extending outward therefrom; and, b) a pair of electrically conductive electrodes disposed on said handle portion in non-contacting relationship, said electrodes being connected to said input of said control circuit means whereby changes in resistance between said electrodes when bridged by a hand during gripping of said handle portion provide said changing stimulus to said control circuit means.

3. The amusement device of claim 1 wherein the device is a meter device and additionally comprising:

a) a meter case having the plasma discharge tube extending along a surface thereof as an indicator, said surface having conditional indicia thereon disposed adjacent and parallel to said plasma discharge tube whereby progressive illumination of said plasma discharge tube causes said plasma discharge tube in combination with said indicia to indicate degrees of a condition associated with a human employing the amusement device; and b) input means having a pair of electrically conductive electrodes disposed thereof for contact with a variably resistive element of the human's body, said electrodes being in non-contacting relationship and being connected to said input of said control circuit means whereby changes in resistance between said electrodes when bridges by a said variably resistive element will provide said changing stimulus to said control circuit means.

4. The amusement device of claim 1 wherein the device is a light organ type device and additionally comprising:

a) a base having said plasma discharge tube extending upward therefrom; and, b) audio input means connected to said output of said control circuit means for applying an audio signal thereto whereby changes in said audio signal provide said changing stimulus to said control circuit means and the plasma discharge tube operates in a vertically extending illumination pattern associated with said audio signal.

5. The amusement device of claim 6 wherein said audio input means comprises:

a) microphone means for developing an electrical signal at an output thereof reflecting sounds heard by said microphone means; and, b) amplifier means operably connected to said input of said control circuit means for receiving said electrical signal at an input thereof and for amplifying said electrical signal to a level sufficient to stimulate said control circuit means into ionizing the gas in the plasma discharge tube as a function of said audio signal, said microphone means and said amplifier means being disposed in said base.

6. A light saber amusement device comprising:

a) a gas-filled plasma discharge tube;

b) a single electrode means adjacent only one end of said tube for coupling high-frequency, high-voltage energy into ionizable gas in said plasma discharge tube;

c) ionization energy supply means operably connected to a source of electricity for producing adjustable ramp voltage radio frequency energy at an output thereof operating at a frequency sufficient to ionize the gas in said plasma discharge tube without a ground return by utilizing the electrical capacity of the surroundings to provide a reactive impedance for plasma tube current to flow into, said electrode means being operably connected to said output;

d) control circuit means operably connected to said ionization energy supply means for adjusting the level of said energy at said output as a function of a changing stimulus connected to an input thereof whereby the length of ionization of the gas along said plasma discharge tube in a direction away from the single electrodes means is varied depending upon said energy;

e) a handle portion for gripping having said plasma discharge tube extending outward therefrom; and, f) a pair of electrically conductive electrodes disposed on said handle portion in non-contacting relationship, said electrodes being connected to said input of said control circuit means whereby changes in resistance between said electrodes when bridged by a hand during gripping of said handle portion provide said changing stimulus to said control circuit means.

7. A meter type amusement device comprising:

a) a gas-filled plasma discharge tube;

b) a single electrode means adjacent only one end of said tube for coupling high-frequency, high-voltage energy into ionizable gas in said plasma discharge tube;

c) ionization energy supply means operably connected to a source of electricity for producing adjustable ramp voltage radio frequency energy at an output thereof operating at a frequency sufficient to ionize the gas in said plasma discharge tube without a ground return by utilizing the electrical capacity of the surroundings to provide a reactive impedance for plasma tube current to flow into, said electrode means being operably connected to said output;

d) control circuit means operably connected to said ionization energy supply means for adjusting the level of said energy at said output as a function of a changing stimulus connected to an input thereof whereby the length of ionization of the gas along said plasma discharge tube in a direction away from the single electrode means is varied depending upon said energy;

e) a meter case having said plasma discharge tube extending along a surface thereof as an indicator, said surface having conditional indicia thereon disposed adjacent and parallel to said plasma discharge tube whereby progressive illumination of said plasma discharge tube causes said plasma discharge tube in combination with said indicia to indicate degrees of a condition of a human using the amusement device; and, f) input means having a pair of electrically conductive electrodes disposed thereon for contact with a variable resistive portion of the human's body, said electrodes being in non-contacting relationship and being connected to said input of said control circuit means whereby changes in resistance between said electrodes when bridged by said variable resistive portion of the human's body will provide said changing stimulus to said control circuit means.

8. A light organ type amusement device comprising:

a) a gas-filled plasma discharge tube;

b) a single electrode means adjacent only one end of said tube for coupling high-frequency, high-voltage energy into ionizable gas in said plasma discharge tube;

c) ionization energy supply means operably connectable to a source of electricity for producing adjustable ramp voltage radio frequency energy at an output thereof operating at a frequency sufficient to ionize the gas in said plasma discharge tube without a ground return by utilizing the electrical capacity of the surroundings to provide a reactive impedance for plasma tube current to flow into, said electrode means being operable connected to said output;

d) control circuit means operably connected to said ionization energy supply means for adjusting the level of said energy at said output as a function of a changing stimulus connected to an input thereof whereby the length of ionization of the gas along said plasma discharge tube in a direction away from the single electrode means is varied depending upon said energy;

e) a base having said plasma discharge tube extending upward therefrom; and, f) audio input means connected to said input of said control circuit means for applying an audio signal thereto whereby changes in said audio signal provide said changing stimulus to said control circuit means and the plasma discharge the tube operates in a vertically extending illumination pattern associated with said audio signal.

9. The light organ type amusement device of claim 8 wherein said audio input means comprises:

a) microphone means for developing an electrical signal at an output thereof reflecting sounds heard by said microphone means; and, b) amplifier means operably connected to said input of said control circuit means for receiving said electrical signal at an input thereof and for amplifying said electrical signal to a level sufficient to stimulate said control circuit means into ionizing the gas in the plasma discharge tube as a function of said audio signal, said microphone means and said amplifier means being disposed in said base.

10. A light organ type amusement device according to claim 8, wherein the input of the control circuit means is a cylindrical plastic grip having conductive foil electrode means on the exterior surface thereof and indicia positioned along side said discharge tube.

* * * * *

UNITED STATES PATENT AND TRADEMARK OFFICE

CERTIFICATE OF CORRECTION

PATENT NO. : 5,089,745

DATED : February 18, 1992

INVENTOR(S) : ROBERT E. IANNINI

It is certified that error appears in the above-identified patent and that said Letters Patent is hereby corrected as shown below:

Column 10, line 46 change "bridges" to --bridged--; and line 61 change "6" to --4--.

Signed and Sealed this

Twenty-seventh Day of April, 1993

*Attest:*

MICHAEL K. KIRK

*Attesting Officer*

*Acting Commissioner of Patents and Trademarks*